US006752646B2

(12) United States Patent
McCoy

(10) Patent No.: US 6,752,646 B2
(45) Date of Patent: Jun. 22, 2004

(54) COMPRESSOR PLUG CAP ASSEMBLY

(75) Inventor: Phillip A. McCoy, Albion, IN (US)

(73) Assignee: Dekko Technologies, Inc., North Webster, IN (US)

( * ) Notice: Subject to any disclaimer, the term of this patent is extended or adjusted under 35 U.S.C. 154(b) by 0 days.

(21) Appl. No.: 10/154,032

(22) Filed: May 23, 2002

(65) Prior Publication Data

US 2003/0040212 A1 Feb. 27, 2003

Related U.S. Application Data

(60) Provisional application No. 60/303,526, filed on Aug. 27, 2001.

(51) Int. Cl.[7] ..... H01R 13/62
(52) U.S. Cl. ..... 439/367
(58) Field of Search ..... 439/367, 521, 439/368, 369, 371

(56) References Cited

U.S. PATENT DOCUMENTS

| | | | | | |
|---|---|---|---|---|---|
| 3,786,828 | A | | 1/1974 | Krechel | 137/116 |
| 5,131,858 | A | | 7/1992 | Heimbrock | 439/181 |
| 5,145,417 | A | | 9/1992 | Honkomp et al. | 439/685 |
| 5,199,898 | A | | 4/1993 | Wisner | 439/367 |
| 5,336,105 | A | | 8/1994 | Wisner | 439/367 |
| 5,584,716 | A | | 12/1996 | Bergman | 439/282 |
| 5,664,959 | A | | 9/1997 | Duell et al. | 439/278 |
| 6,056,580 | A | * | 5/2000 | Cross et al. | 439/369 |
| 6,080,004 | A | * | 6/2000 | Kovacik et al. | 439/369 |
| D440,541 | S | | 4/2001 | Nakayama et al. | D13/146 |

* cited by examiner

*Primary Examiner*—Ross Gushi
(74) *Attorney, Agent, or Firm*—Taylor & Aust, P.C.

(57) ABSTRACT

A compressor plug cap assembly includes a compressor plug and a fence member. The compressor plug has a first plug side face and an opposing second plug side face, the first plug side face configured for operative association with a compressor. The fence member substantially surrounds and is operatively connected to the compressor plug. The fence member is mounted relative to the compressor plug so as to substantially coextend with the first plug side face and to extend beyond the second plug side face. The fence member has a top fence side and a bottom fence side, each of the top fence side and the bottom fence side being substantially open.

9 Claims, 3 Drawing Sheets

COMPRESSOR PLUG CAP ASSEMBLY

CROSS REFERENCE TO RELATED APPLICATIONS

This is a non-provisional application based upon U.S. provisional patent application Serial No. 60/303,526, entitled "COMPRESSOR PLUG CAP ASSEMBLY", filed Aug. 27, 2001.

BACKGROUND OF THE INVENTION

1. Field of the Invention

The present invention relates to electrical connectors, and, more particularly, to electrical connectors which couple with an electrical plug of a compressor.

2. Description of the Related Art

Compressor plugs are used to create an electrical connection to a terminal of a hermetic compressor. Such a compressor is typically employed in a refrigeration or air conditioning system.

Like in other situations where exposure to possible live electrical connections is possible, it is known to provide some sort of housing unit (akin to a junction box used in other situations) around the compressor plug as a preventive measure. Specifically, it has been known to use a housing unit that includes a fence member and a corresponding lid to enclose the compressor plug.

A problem associated with the electrical interconnects associated with the compressor and the compressor plug is that they tend to not be very robust mechanically. Consequently, these electrical interconnects can be broken, mechanically and thus electrically, rather easily.

In the embodiments of the known housing unit discussed above, the lid is mechanically associated with the compressor plug, either by contact or by an interconnection therebetween. As such, any impact upon the lid is transferred not only to the fence member but also to the compressor plug, thereby risking breakage of at least some of the electrical interconnects associated therewith. Additionally, the presence of the lid on the fence limits access to the compressor plug.

What is needed in the art is a housing member that can be readily held in place mechanically relative to the compressor plug, provide appropriate impact protection to the compressor plug and electrical interconnects associated therewith and still provide sufficient electrical shielding of those electrical interconnects.

SUMMARY OF THE INVENTION

The present invention provides a compressor plug assembly that includes a protective fence member that is readily connectable to a compressor plug and that helps protect the compressor plug from impact while still permitting access thereto.

The invention comprises, in one form thereof, a compressor plug cap assembly that includes a compressor plug and a fence member. The compressor plug has a first plug side face and an opposing second plug side face, the first plug side face configured for operative association with a compressor. The fence member substantially surrounds and is operatively connected to the compressor plug. The fence member is mounted relative to the compressor plug so as to substantially coextend with the first plug side face and to extend beyond the second plug side face. The fence member has a top fence side and a bottom fence side, each of the top fence side and the bottom fence side being substantially open.

The invention comprises, in another form thereof, a compressor plug cap assembly including a compressor plug, a fence member and a latch bail. The compressor plug has a diametrically opposed pair of arcuate receiver members associated therewith. The fence member is configured for mechanically receiving said compressor plug therein. The fence member at least partially surrounds the compressor plug. The fence member has a pair of receiver slots therein, the receiver slots being diametrically opposed to and generally parallel to each other, The fence member has a curved end portion, the curved end portion having a tang slot therein. The latch bail has a generally U-shaped configuration. The latch bail has a pair of bail ends, each bail end operatively mating with and pivotably mounted within one receiver slot. Each bail end has a bail extension portion extending toward the compressor plug. Each bail extension portion is received within a respective arcuate receiver member. The latch bail has a rounded mid-section, the latch bail including a tang extension thereat. The tang extension operatively fits in the tang slot of the fence member.

The invention comprises, in yet another form thereof, a compressor plug cap assembly that includes a compressor plug and a fence member. The compressor plug has a diametrically opposed pair of plug tabs extending therefrom. The fence member is configured for mechanically receiving the compressor plug therein. The fence member at least partially surrounds the compressor plug. The fence member has a diametrically opposed pair of receiver notches therein, each receiver notch receiving a corresponding plug tab therein.

An advantage of the present invention is that the fence member of the compressor plug assembly is configured for protecting the compressor plug from impact while still promoting easy access thereto.

Another advantage is that simple yet robust mechanical connections are used to hold together the elements of the compressor plug assembly.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
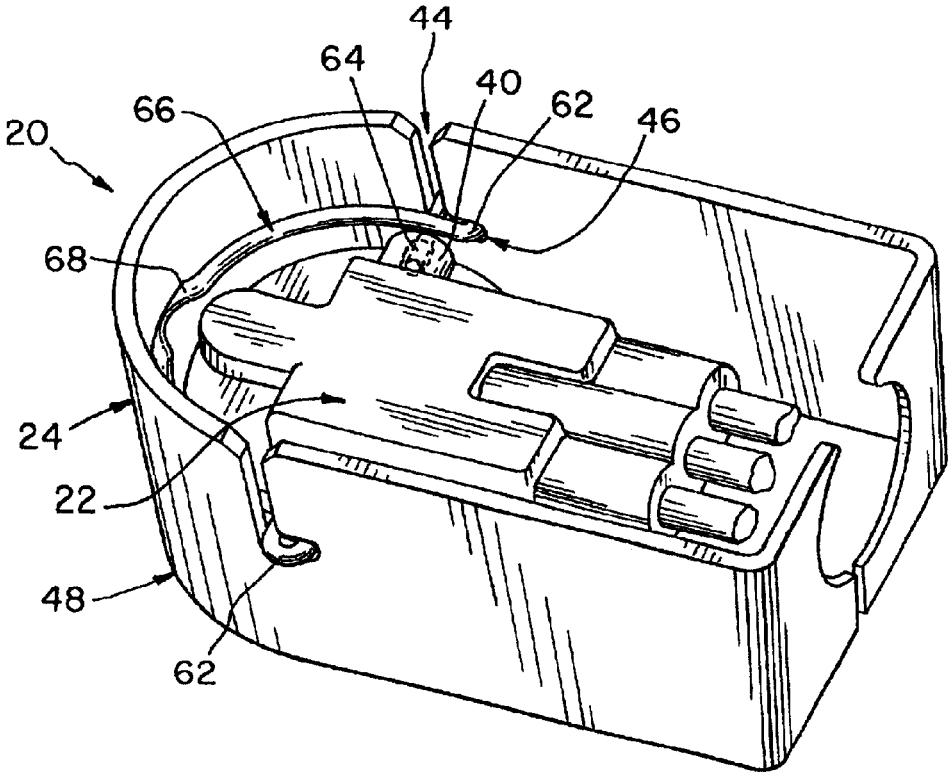
FIG. 1 is a perspective view of a first embodiment of the compressor plug assembly of the present invention.

Corresponding reference characters indicate corresponding parts throughout the several views. The exemplifications set out herein illustrate at least one preferred embodiment of the invention, in one form, and such exemplifications are not to be construed as limiting the scope of the invention in any manner.

DETAILED DESCRIPTION OF THE INVENTION

Referring now to the drawings, and more particularly to FIG. 1, there is shown a compressor plug cap assembly 20 which generally includes a compressor plug 22, fence member 24 and latch bail 26.

Figure 2:
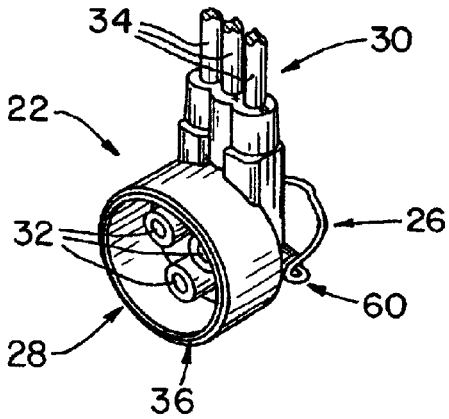
FIG. 2 is a perspective view of the latch bail/compressor plug subassembly of the first embodiment.
Figure 3:
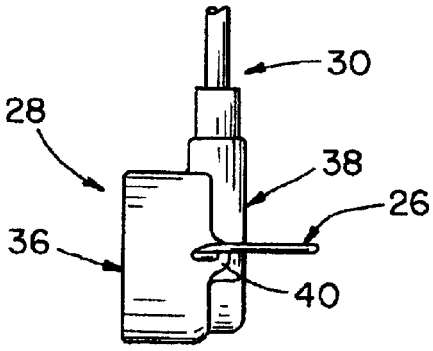
FIG. 3 is a side view of the latch bail/compressor plug subassembly shown in FIG. 2.

Compressor plug 22 is used in association with a compressor (not shown) of a household appliance (e.g., a refrigerator, freezer, etc.). The body of compressor plug 22 is typically made of an elastomeric material (such as the one sold under the trade name of Santopreme 253-36). Compressor plug 22 includes a plug end 28 (FIG. 2) and a conductor out-feed end 30. Female receptacle members 32 within plug end 28 facilitate an electrical connection between an electrical connector (not shown) of the compressor, while out-feed conductors 34 of conductor out-feed end 30 permit a connection with a power source (not shown). Compressor plug 22 has a first side face 36 (best seen in FIG. 3) and an opposing second side face 38. Access to female receptacle members 32 is available via first side face 36.

Additionally, generally orthogonal to both out-feed conductors 34 and second side face 38, compressor plug 22 has a diametrically opposed pair of substantially arcuate receiver members 40 (FIGS. 3, 4) associated therewith. Arcuate receiver members 40, while shown to be generally semicircular and to be integral with compressor plug 22 in this embodiment, instead could take other arcuate forms (such as circular, oval or semi-oval) and/or could be attached to (as opposed to integral with) compressor plug 22.

Figure 4:
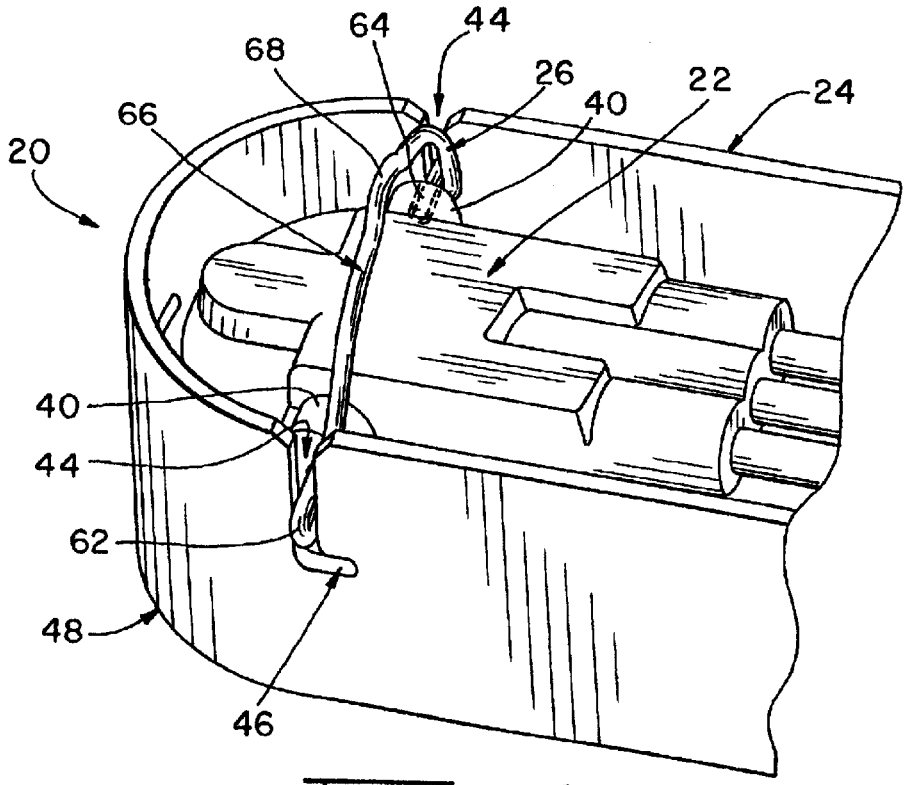
FIG. 4 is a perspective, partially assembled view of the first embodiment.
Figure 5:
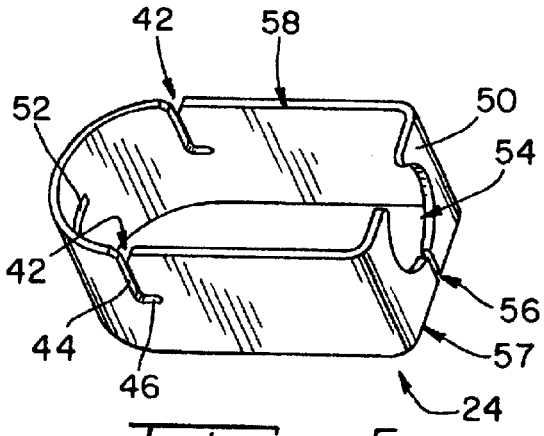
FIG. 5 is a perspective view of the fence member of the first embodiment.

Fence member 24 is configured for mechanically receiving compressor plug 22 therein in a manner such that fence member 24 at least partially surrounds compressor plug 22. Fence member 24 is advantageously composed of cold-rolled steel or other material that permits fence member 24 to withstand a dropped steel ball test (i.e., impact resistant). Fence member 24 has a pair of receiver slots 42 therein (as best seen in FIGS. 4 and 5), receiver slots 42 being diametrically opposed to and generally parallel to each other. Each receiver slot 42 is substantially L-shaped, having a primary slot portion 44 and a shorter secondary slot portion 46. Fence member 24 has a curved end portion 48 and a second end portion 50 opposite curved end portion 48. Curved end portion 48 has a tang slot 52 therein, while second end portion 50 has an out-feed receptor slot 54 therein, out-feed receptor slot 54 receiving conductor out-feed end 30 of compressor plug 22 therein. In this embodiment out-feed receptor slot 54 is nearly a complete circle with an upper opening (not labeled) to permit insertion and, yet, promote retention of conductor out-feed end 30 therein.

Second end portion 50 is further provided with a sizing notch 56 below and in communication with out-feed receptor slot 54. As such, the presence of sizing notch 56 allows out-feed receptor slot 54 to be opened to greater than its normal width, thereby easing insertion of conductor out-feed end 30 therein. Additionally, if conductor out-feed end 30 is wider than out-feed receptor slot 54, a force fit (e.g., a snap fit) therebetween will result, thereby aiding in the retention of compressor plug 22 within fence member 24.

Fence member 24 coextends with first side face 36 of compressor plug 22, fence bottom 57 of fence member 24 and first side face 36 thereby being configured for adjoining a compressor (not shown) to which compressor plug 22 is to be electrically connected. Meanwhile, fence member 24 extends beyond second side face 38 of compressor plug 22. The resulting gap between fence top 58 of fence member 24 and second side face 38 of compressor plug 22 effectively protects both female receptacle members 32 within plug end 28 and the electrical connector of the compressor from various objects that may strike (e.g., such as from falling) fence member 24 that would otherwise impact directly on compressor plug 22 if such a gap were to not exist. Such a degree of impact protection is achieved without placing a lid upon fence member 24, thereby permitting relatively ready accessibility to compressor plug 22. Fence bottom 57 and fence top 58 are substantially open, thereby permitting easy access into fence member 24.

Figure 6:
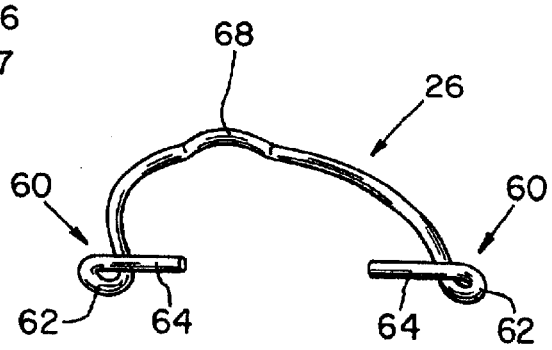
FIG. 6 is a perspective view of the latch bail of the first embodiment.
Figure 7:
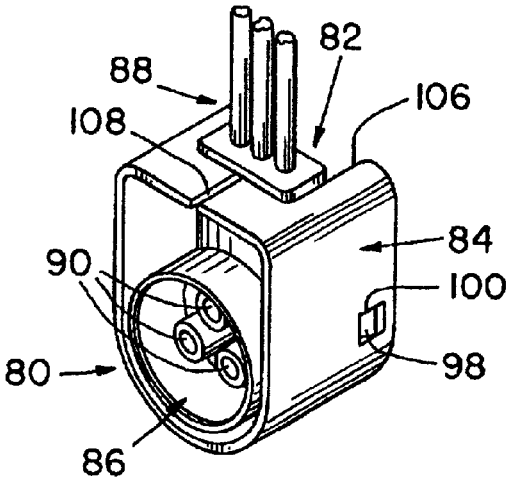
FIG. 7 is a perspective view of a second embodiment of the compressor plug assembly of the present invention.
Figure 8:
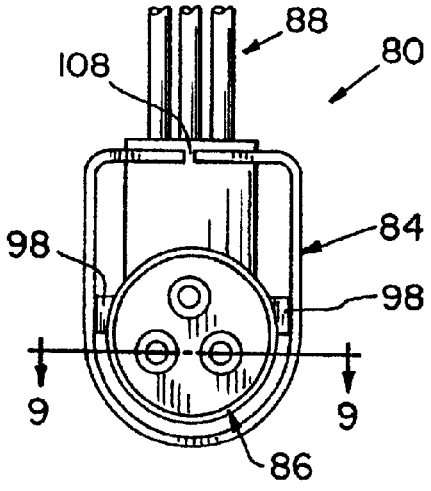
FIG. 8 is a bottom view of the second embodiment of the compressor plug assembly of the present invention.
Figure 9:
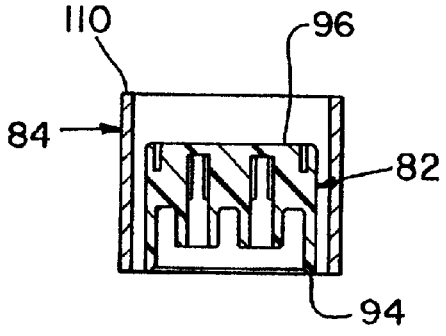
FIG. 9 is a section view taken along section line 9—9 in FIG. 8.
Figure 10:
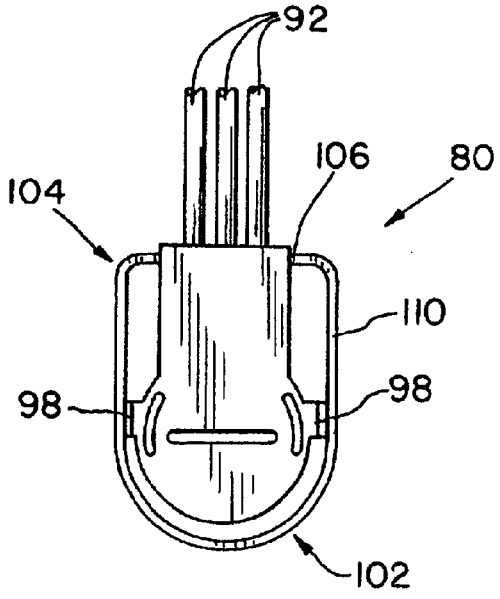
FIG. 10 is a top view of the second embodiment of the compressor plug assembly of the present invention.

Latch bail 26 has a generally U-shaped configuration (as seen from FIGS. 1, 4 and 6) and usually is formed of a bent wire. Latch bail 26 has a pair of bail ends 60, each bail end 60 operatively mating with and pivotably mounted within a respective receiver slot 42 in fence member 24. Each bail end 60 has a bail end ear 62, bail end ear 62 being initially receivable in a respective primary slot portion 44 of receiver slot 42 in fence member 24 and then pivotably receivable within a respective secondary slot portion 46 thereof As seen from FIG. 1, the combined configuration of each bail end ear 62 and each L-shaped receiver slot 42 helps to retain latch bail 26 in the locked position, shown in FIG. 1, within fence member 24.

Each bail end 60 has a bail extension portion 64 extending toward the other of bail ends 60 and, when latch bail 26 is assembled with the rest of compressor plug cap assembly 20, each bail extension portion 64 extends toward compressor plug 22. Specifically, each bail extension portion 64 is inserted and pivotably received within a respective arcuate receiver member 40 of compressor plug 22.

Latch bail 26 has a rounded mid-section 66 and has a tang extension 68 at rounded midsection 66 thereof Tang extension 68 operatively fits in tang slot 52 of fence member 24. Such an operative fit helps retain latch bail 26 and, via bail extension portions 64, compressor plug 22 within fence member 24.

Latch bail 26 is springably expanded, positioned relative to compressor plug 22 and then released to allow insertion of each batch extension portion 64 in respective arcuate receiver member 40. Latch bail 26, via the pivotable connection between each batch extension portion 64 and respective arcuate receiver member 40, is positioned so as to be substantially orthogonal to compressor plug 22. Compressor plug 22 is now inserted into fence member 24, conductor out-feed end 30 snapping into out-feed receptor slot 54 in second end portion 50 and each bail end ear 62 slidably fitting into primary slot portion 44 of respective receiver slot 42 within fence member 24. Locking of latch bail 26 relative to fence member 24 is achieved by rotating latch bail 26 toward a parallel position with respect to compressor plug 22. At the end of that rotation, tang extension 68 of latch bail 26 engages tang slot 52 in fence member 24 and each bail end ear 62 moves into secondary slot portion 44 of respective receiver slot 42.

In an alternate embodiment shown in FIGS. 7–10, compressor plug cap assembly 80 includes a compressor plug 82 and a fence member 84.

Compressor plug 82 includes a plug end 86 and a conductor out-feed end 88. Female receptacle members 90 within plug end 86 facilitate an electrical connection between an electrical connector (not shown) of the compressor, while out-feed conductors 92 of conductor out-feed end 88 permit a connection with a power source (not shown). Compressor plug 82 has a first side face 94 and an opposing second side face 96. Access to female receptacle members 90 is available via first side face 94.

Additionally, compressor plug 82 has a diametrically opposed pair of tab members 98 associated therewith, each tab member 98 located on plug end 86 at a position generally orthogonal to out-feed conductors 92 and below second side face 96. Each tab member 98 extends angularly upward toward second side face 96.

Fence member 84 is configured for mechanically receiving compressor plug 82 therein in a manner such that fence member 84 at least partially surrounds compressor plug 82. Fence member 84 has a pair of tab receiver apertures 100 therein (as best seen in FIGS. 4 and 5), tab receiver apertures 100 being diametrically opposed to each other and positioned so as to receive a corresponding tab member 84 of compressor plug 82 therein.

Fence member 84 has a curved end portion 102 and an opposite second end portion 104. Second end portion 104 has an out-feed receptor slot 106 therein, out-feed receptor slot 106 receiving conductor out-feed end 88 of compressor plug 82 therein. In this embodiment, out-feed receptor slot 106 is substantially orthogonal (i.e., rectangular in shape).

Second end portion 104 is further provided with a sizing notch 108 below and in communication with out-feed receptor slot 106. As such, the presence of sizing notch 108 allows out-feed receptor slot 106 to be opened to greater than its normal width, thereby easing insertion of conductor out-feed end 88 therein. Additionally, by configuring conductor out-feed end 88 to be wider than out-feed receptor slot 106 (in its unexpanded, relaxed state), a force fit therebetween can be achieved, thereby aiding in the retention of compressor plug 82 within fence member 84.

Fence member 84 coextends with first side face 94 of compressor plug 82, fence member 84 and first side face 94 thereby being configured for adjoining a compressor (not shown) to which compressor plug 82 is to be electrically connected. Meanwhile, fence member 84 extends beyond second side face 96 of compressor plug 82. The resulting gap between fence top 110 of fence member 84 and second side face 96 of compressor plug 82 effectively protects both female receptacle members 90 within plug end 86 and the electrical connector of the compressor from various objects that may strike (e.g., such as from falling) fence member 84 that would otherwise impact directly on compressor plug 82 if such a gap were to not exist. Such a degree of impact protection is achieved without placing a lid upon fence member 84, thereby permitting relatively ready accessibility to compressor plug 82.

Compressor plug 82 is inserted into fence member 84. In the process, conductor out-feed end 88 snaps into out-feed receptor slot 106 in second end portion 104 and each tab member 98 snaps into respective tab receiver aperture 100 within fence member 84. As such, compressor plug cap assembly 80 offers the advantage of quick and easy assembly.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compressor plug cap assembly, comprising:

a compressor plug having a diametrically opposed pair of arcuate receiver members associated therewith;

a fence member configured for mechanically receiving said compressor plug therein, said fence member at least partially surrounding said compressor plug, said fence member having a pair of receiver slots therein, said receiver slots being diametrically opposed to and generally parallel to each other, said fence member having a curved end portion, said curved end portion having a tang slot therein; and a latch bail having a generally U-shaped configuration, said latch bail having a pair of bail ends, each said bail end operatively mating with and pivotably mounted within one said receiver slot, each said bail end having a bail extension portion extending toward said compressor plug, each said bail extension portion received within a respective said arcuate receiver member, said latch bail having a rounded mid-section, said latch bail including a tang extension at said rounded mid-section thereof, said tang extension operatively fitting in said tang slot of said fence member.

2. The compressor plug cap assembly of claim 1, wherein said compressor plug is configured for electrically coupling a compressor to an electrical power supply.

3. The compressor plug cap assembly of claim 1, wherein said compressor plug includes a plug end and a conductor out-feed end, said fence member having a second end portion opposite said curved end portion, said second end portion having an out-feed receptor slot therein, said out-feed receptor slot receiving said conductor out-feed end of said compressor plug therein.

4. The compressor plug cap assembly of claim 1, wherein said compressor plug has a first side face and an opposing second side face, said fence member coextending with said first side face, said fence member extending beyond said second side face.

5. The compressor plug cap assembly of claim 1, wherein said latch bail is formed of a bent wire.

6. The compressor plug cap assembly of claim 1, wherein each said bail end of said latch bail has a bail end ear, each said receiver slot being substantially L-shaped, each said receiver slot thereby having a primary slot portion and a shorter secondary slot portion each said bail end ear being initially receivable in a respective said primary slot portion and then pivotably receivable within a respective said secondary slot portion.

7. The compressor plug cap assembly of claim 1, wherein said compressor plug includes a plug end and a conductor out-feed end, said fence member having a curved end portion for receiving said plug end therein, said fence member having a second end portion opposite said curved end portion, said second end portion having out-feed receptor slot therein, said out-feed receptor slot receiving said conductor out-feed end of said compressor plug therein.

8. A compressor plug cap assembly comprising:

a compressor plug, said compressor plug having a diametrically opposed pair of plug tabs extending therefrom, said compressor plug having a first side face and an opposing second side face;

a fence member configured for mechanically receiving said compressor plug therein, said fence member at least partially surrounding said compressor plug, said fence member having a diametrically opposed pair of receiver notches therein, each said receiver notch receiving a corresponding plug tab therein, said fence member coextending with said first side face, said fence member extending beyond said second side face.

9. A compressor plug cap assembly, comprising:

a compressor plug having a first plug side face and an opposing second plug side face, said first plug side face configured for operative association with a compressor; and a fence member substantially surrounding and operatively connected to said compressor plug, said fence member mounted relative to said compressor plug so as to substantially coextend with said first plug side face and to extend beyond said second plug side face, said fence member having a top fence side and a bottom fence side, each of said top fence side and said bottom fence side being substantially open.

* * * * *